US006172583B1

(12) United States Patent
Niekamp et al.

(10) Patent No.: US 6,172,583 B1
(45) Date of Patent: Jan. 9, 2001

(54) WAVEGUIDE SYSTEM HAVING A TROUGH AND WITH INWARD EXTENDING FLANGES

(76) Inventors: Rex Leonard Niekamp, 4103 N. 36, Quincy, IL (US) 62301; Spencer J. Smith, Rte. 26, P.O. Box 1176, Gray, ME (US) 04039

( * ) Notice: Under 35 U.S.C. 154(b), the term of this patent shall be extended for 0 days.

(21) Appl. No.: 09/054,882

(22) Filed: Apr. 3, 1998

(51) Int. Cl.[7] ..... H01P 1/04; H01P 3/123

(52) U.S. Cl. ..... 333/254; 333/248

(58) Field of Search ..... 333/239, 242, 333/248, 254

(56) References Cited

U.S. PATENT DOCUMENTS

| | | | | |
|---|---|---|---|---|
| 2,199,083 | | 4/1940 | Schelkunoff | 333/239 X |
| 2,477,510 | | 7/1949 | Chu | 333/157 X |
| 2,677,111 | | 4/1954 | Stahl et al. | 333/230 X |
| 3,136,965 | * | 6/1964 | Lunden | 333/239 |
| 4,144,506 | | 3/1979 | McCammon et al. | 333/26 |
| 4,894,625 | | 1/1990 | Niekamp et al. | 333/33 |

FOREIGN PATENT DOCUMENTS

| | | | | |
|---|---|---|---|---|
| 76604 | * | 6/1981 | (JP) | 333/239 |

OTHER PUBLICATIONS

Riley et al, "Machined Two–Piece Microwave Waveguide"; *U.S Statutory Invention Registration H 321*; Aug. 4, 1987.*

* cited by examiner

*Primary Examiner*—Benny Lee
(74) *Attorney, Agent, or Firm*—Tarolli, Sundheim, Covell, Tummino & Szabo L.L.P.

(57) ABSTRACT

A waveguide system that includes a plurality of waveguide sections, each taking the form of an elongated longitudinally extending tubular member having a substantially circular shaped wall in cross section which coaxially surrounds a longitudinal axis. The wall has a longitudinally extending trough portion extending radially inward toward the longitudinal axis. The trough portion is defined by a pair of circumferentially spaced wall portions extending inwardly and joined together by a connecting wall portion. The wall portions together define a ridge having an inner surface on the interior side of the wall and an outer surface on the exterior side of the wall. Each waveguide section has opposing ends with each end having a longitudinally extending peripheral lip at the ridge. The wall has at each said end an annular mounting flange extending essentially radially outward from the exterior side of the wall. A plurality of spaced apart fastening means interconnect the annular mounting flanges of adjoining waveguide sections together in such a manner that at least one of interconnecting means is located in trough portion.

17 Claims, 6 Drawing Sheets

WAVEGUIDE SYSTEM HAVING A TROUGH AND WITH INWARD EXTENDING FLANGES

BACKGROUND AND FIELD OF THE INVENTION

The present invention relates to the art of waveguides and, more particularly, to improved means for interconnecting a plurality of waveguide sections. The waveguide system is suitable for use over a wide UHF frequency band with either analog, NTSC, television signals or digital, DTV, television signals.

DESCRIPTION OF THE PRIOR ART

Waveguide systems are known in the art for efficiently transmitting RF energy from a transmitter to a broadcasting antenna located on the top of a tower. Such a tower may have a height on the order of 1,000 feet, requiring a vertical waveguide of the same length. The antenna located on the top of the tower may have a length on the order of 50 feet. Such an arrangement is disclosed in the United States Patent to Niekamp, et al. 4,894,625. That patent discloses a waveguide system including a lower horizontally extending waveguide which extends from a coaxial cable connection at an RF transmitter to a vertical waveguide which extends vertically for a length corresponding to that of the height of a tower and, thence, to a horizontally extending waveguide at the top of the tower which, in turn, feeds RF energy to the vertically extending antenna. The horizontal and vertical waveguide portions of this waveguide antenna system, as described in the Niekamp patent, are of rectangular cross section. The vertical waveguide being of rectangular cross section and being of approximately 1,000 feet, represents a substantial wind load. This wind load may be reduced by a vertical waveguide which is circular in cross section.

One form of circular waveguide known in the art has been described as a lunar waveguide. Such a waveguide has advantages over a simple circular shaped waveguide because it may have a smaller diameter for the same frequency of operation and, hence, provides a reduction in wind load. Such a lunar waveguide is illustrated in prior art such as L. J. Chu U.S. Pat. No. 2,477,510 and to S. A. Schelkunoff U.S. Pat. No. 2,199,083 and in the Niekamp patent, supra.

In addition to low wind load, such a lunar waveguide may be employed in a single size to cover the entire UHF frequency band (from approximately 470 MHz to 806 MHz). Consequently, such a waveguide may be employed in transmitting multiple digital television signals (DTV) as well as multiple analog television signals (NTSC) or combinations of each.

As noted in the Niekamp patent, supra, such a lunar waveguide may be considered as an elongated circular wrapped rectangular waveguide having an elongated metallic annular wall having an upper end and a lower end. A partition member, known as a septum, extends radially inward from the annular wall. The inner edge of the septum may be rounded somewhat and is referred to as a ridge. This ridge may be located near the central or longitudinal axis of the annular wall and extends along the septum longitudinally for a length corresponding with that of the annular wall.

If such a lunar waveguide is employed as the vertical waveguide portion, it may extend upwardly within a tower for a distance on the order of 1,000 feet. The 1,000 foot vertical waveguide is broken into a plurality of waveguide sections each being of a length of approximately 10 to 30 feet for ease of installation. Each waveguide section has opposing ends. The facing ends of adjoining sections may be secured together by means of annular extending flanges and fastening means, such as nuts and bolts. More specifically, at the end of each waveguide section an annular flange extends radially outward from the outer surface of the waveguide. These annular flanges are provided with an array of holes for receiving bolts. When adjoining sections are aligned end to end, the facing flanges are positioned so that the mounting holes are in registry and then the bolts and nuts are secured in place.

If the waveguide is constructed following the teachings of the prior art, such as the lunar waveguide antenna illustrated in the Niekamp patent, certain problems will arise. As is known, most of the current flow in a cylindrical waveguide takes place at the interior surface of the waveguide. This current will be intense along the inner surface of the ridge with the maximum taking place at the inner most area of the ridge within the waveguide. This will cause the metal in this area of the ridge to heat up at a greater temperature than that at other areas spaced further away from the center of the waveguide. The bolts and nuts restrain the outer wall and this heating causes the metal of the lip to deform somewhat. Later, as the RF power is reduced or turned off, the ridge will cool causing a gap to take place at the inner most narrow contact surface area of the adjoining ridges. When RF power is returned or increased, there will be a tendency for arcing to take place at these gaps between adjoining ridges. This arcing will decrease the efficiency of the waveguide and cause eventual failure of the joint between the adjoining ridges.

SUMMARY OF THE INVENTION

In accordance with the present invention, there is provided a waveguide system which includes a plurality of waveguide sections, each taking the form of an elongated longitudinally extending tubular member having a substantially circular shaped wall, in cross section, that coaxially surrounds a longitudinal axis. This circular wall has a longitudinal trough portion which extends radially inward toward the longitudinal axis. The trough portion is defined by a pair of circumferentially spaced wall portions that extend inwardly and are joined together by a connecting wall portion. The wall portions together define a ridge having an inner surface on the interior side of the wall and an outer surface on the exterior side of the wall. Each waveguide section has opposing ends with each end having a longitudinally extending peripheral lip. At each end of a waveguide section an annular mounting flange extends essentially radially outward from the exterior side of the wall. A plurality of spaced apart fastening means interconnect the annular mounting flanges of adjoining waveguide sections in such a manner that at least one of the interconnecting means is located in the trough portion for securely fastening the sections together including the respective ridges defined by the trough portion.

BRIEF DESCRIPTION OF THE DRAWINGS

The foregoing and other objects and advantages of the present invention will become more readily apparent from the following as taken in conjunction with the accompanying drawings, wherein.

DESCRIPTION OF A PREFERRED EMBODIMENT

Reference is now made to the drawings, wherein the showings are for purposes of illustrating a preferred embodiment of the invention and not for purposes of limiting same.

Figure 1:
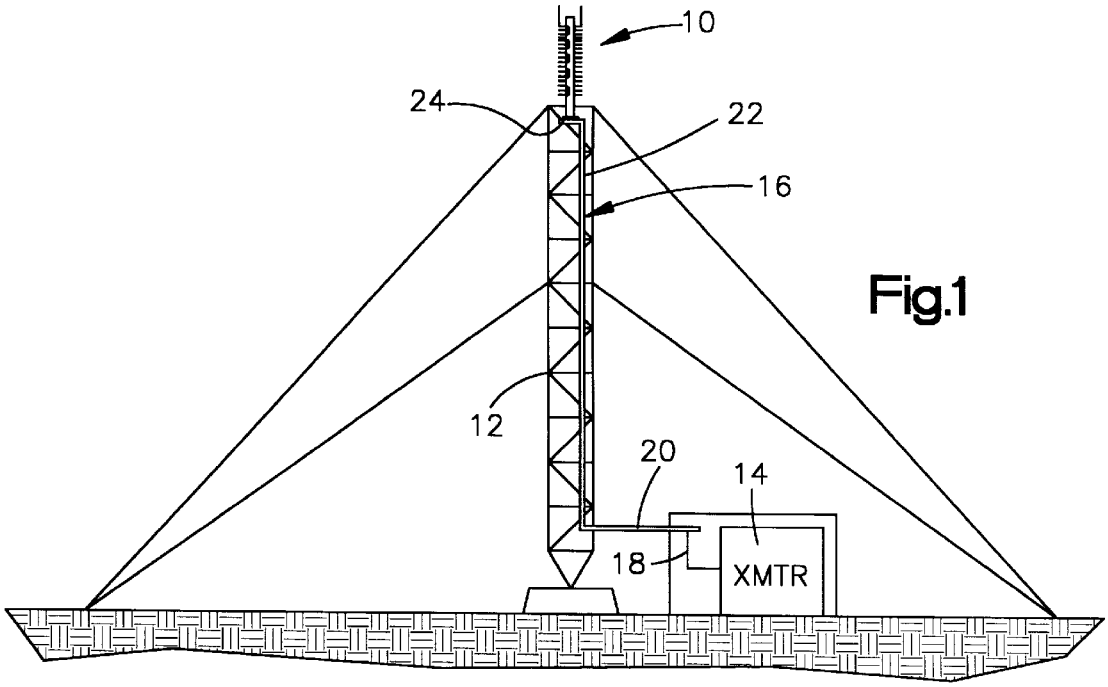
FIG. 1 is a schematic elevational illustration of a UHF antenna system to which the present invention may be employed.
Figure 2:
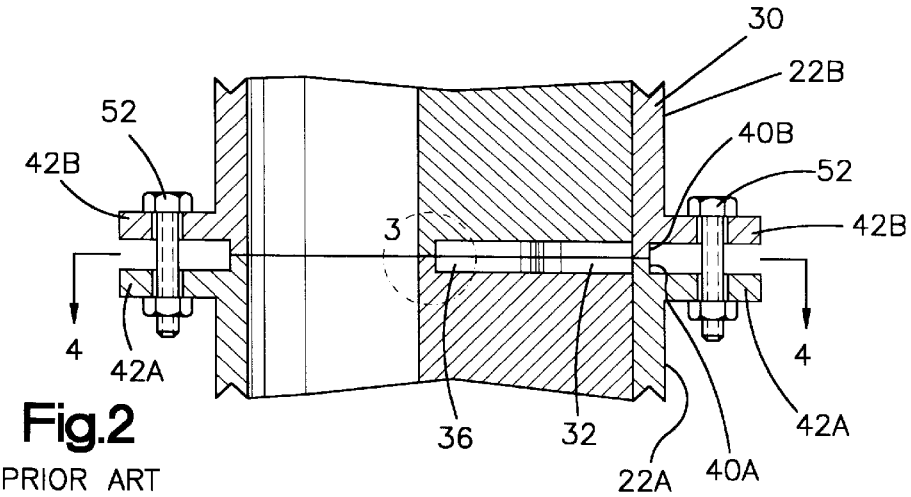
Fig.2 PRIOR ART
FIG. 2 is a sectional view showing an interconnection of two waveguide vertical sections which may be constructed in accordance with the prior art.
Figure 3:
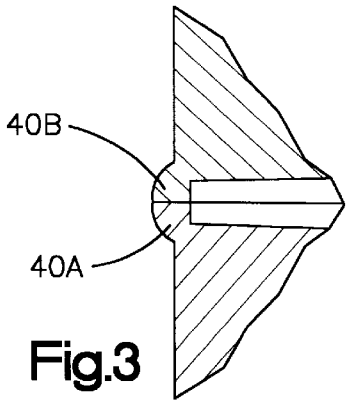
Fig.3 PRIOR ART
FIG. 3 is an exploded sectional view taken from FIG. 2 in the area designated by the circle in FIG. 2.
Figure 4:
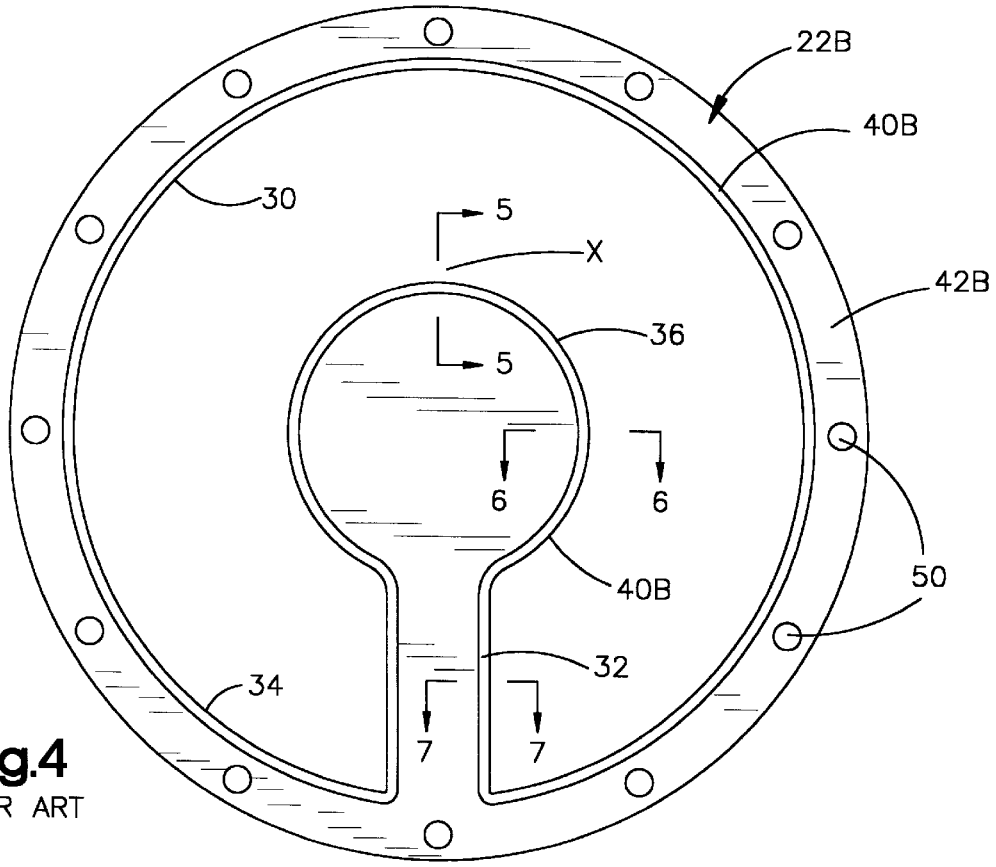
Fig.4 PRIOR ART
FIG. 4 is a sectional view taken generally along line 4—4 looking in the direction of the arrows in FIG. 2.

In FIG. 1 there is illustrated an elevational view of a UHF slotted antenna 10 mounted on the top of a tower structure 12 of conventional design. The tower height may, for example, be on the order of 1,000 feet and the antenna 10 may be on the order of 50 feet. At ground elevation, there is schematically illustrated an RF transmitter 14 (XMTR) which supplies RF energy to a waveguide 16 which, in turn, feeds the antenna 10. The waveguide 16 includes a lower horizontal portion 20 which is connected to a coaxial cable 18, a vertical waveguide portion 22 and a horizontal waveguide portion 24, which is coupled to the antenna 10. The horizontal waveguide portions 20 and 24 may take the form of rectangular waveguides, ridged waveguides or coax lines constructed in accordance with the prior art. Preferably the vertical waveguide portion 22 is circular in cross section to minimize wind load. To further reduce wind load, the vertical waveguide portion is reduced in diameter somewhat by taking the form of a lunar cross section. As shown in FIGS. 2 and 4 this lunar cross section includes an annular wall 30 which coaxially surrounds a longitudinal axis which extends throughout the length of the waveguide portion. The annular wall 30 may be constructed of metal, such as copper or aluminum and has a partition wall or septum 32 which extends radially inward from the interior side 34 (see FIG. 4) of wall 30. The septum 32 is also constructed of metal, such as copper or aluminum, and may be secured to the inner surface 34 of wall 30 as by welding or the like. The septum is coextensive with the longitudinal length of wall 30. The inner edge of the septum extends toward the longitudinal axis of wall 30 and is provided with a ridge 36. The ridge 36 may take the form, for example, of an elongated metal pipe that is coextensive with the septum or the septum and the ridge may be of a unitary structure.

It is known in the art that the RF energy flowing through the interior of a waveguide results in current flowing mainly along the inner surface of the waveguide. To provide for efficiency of operation when two sections of a waveguide are interconnected as shown in FIG. 2, the abutting ends of the two sections are provided with peripheral lip portions at the inner surface areas of the waveguide sections. Thus, as shown in FIGS. 2 and 4 waveguide sections 22A and 22B are mounted end to end with peripheral lips 40B of section 22B and 40A of section 22A abutting each other. In addition, each of the facing ends is provided with a annular mounting flange including annular flange 42B of section 22B and mounting flange 42A of section 22A. As shown in FIG. 4 with respect to section 22B, each of these annular flanges, such as flange 42B, includes a circular array of bolt holes 50. The bolt holes in facing annular flanges such as flanges 42A and 42B are placed in a registry with each other so that the bolt holes may receive suitable nut and bolt assemblies 52 (see FIG. 2) for securing the annular flanges together, in a manner well known in the art. If the vertical length of the vertical waveguide portion 22 is on the order of 1,000 feet and each section is 10 feet long then 100 sections such as 22A and 22B are provided, each pair being connected in a manner as shown in FIGS. 2 and 4.

During operation, the current tends to flow along the inner surface of the waveguide. Consequently, the inner surface of the waveguide heats up and is at a greater temperature than that of the exterior side. The heat increases along the surface of the ridge 36 to a maximum at approximately the 12 o'clock position as indicated by the reference "X" in FIG. 4. This may be explained by the tendency for the current to be more intense at the central portion of the waveguide and or at location "X" there is a greater distance for the heat to dissipate through the septum and thence to the outer wall of the waveguide as opposed to other areas within the waveguide.

During operation the area "X" of the inner most location of ridge 36 heats up to a greater temperature level than that of areas extending away from area "X" toward the wall 30. The ridge area "X", as shown in FIG. 4, causes the lips 40A and 40B of adjoining sections to become deformed as this area goes into material yield resulting in "upsetting" of the metal. The results of such heating is shown in FIGS. 3, 5, 6 and 7. After the power has been lowered or turned off the metal cools causing an air gap 60 at the location "X" on the ridge (see FIG. 5). This location may be looked upon as the 12 o'clock location as viewed in FIG. 4. At a location spaced 90° away from location "X" the gap is somewhat smaller as shown by the reduced gap 62 in FIG. 6. The deformation of the metal is not quite as extensive at that location as it is at location "X".

Figure 5:
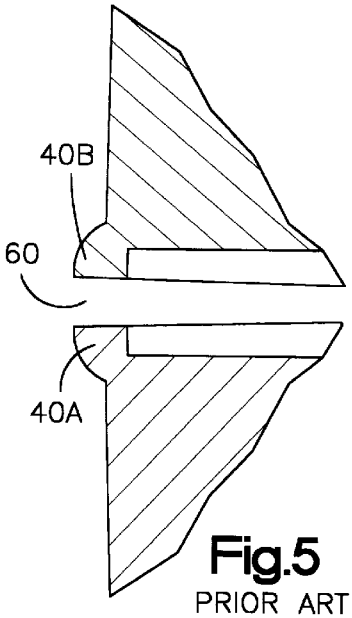
Fig.5 PRIOR ART
FIG. 5 is a sectional view taken along line 5—5 looking in the direction of the arrows in FIG. 4.
Figure 6:
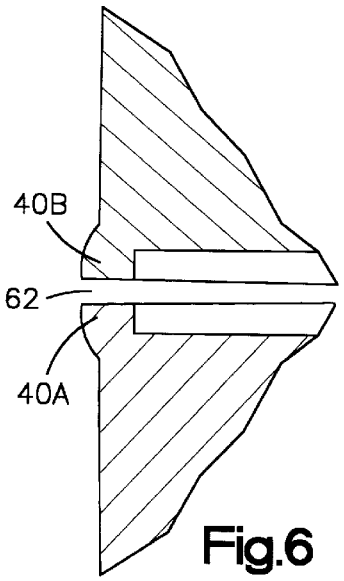
Fig.6 PRIOR ART
FIG. 6 is a sectional view taken generally along line 6—6 looking in the direction of the arrows in FIG. 4.
Figure 7:
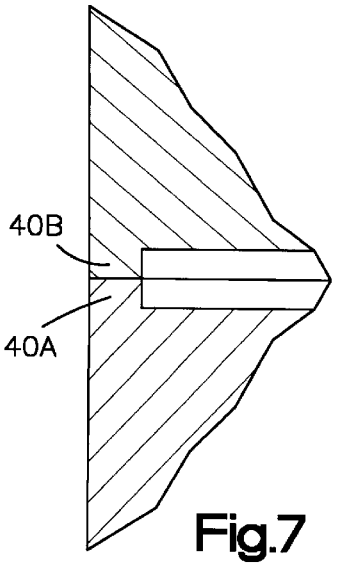
Fig.7 PRIOR ART
FIG. 7 is a sectional view taken generally along line 7—7 looking in the direction of the arrows in FIG. 4.

At a location such as that indicated by FIG. 7, the peripheral lips 40A and 40B are in contact and no gap takes place. This is because, during operation, this area is much cooler than the area at location "X" and the metal is not deformed. The gap as shown in FIGS. 5 and 6 results in higher resistance and arcing between the two waveguide sections as power is increased and this will cause eventual failure of the joint.

Figure 8:
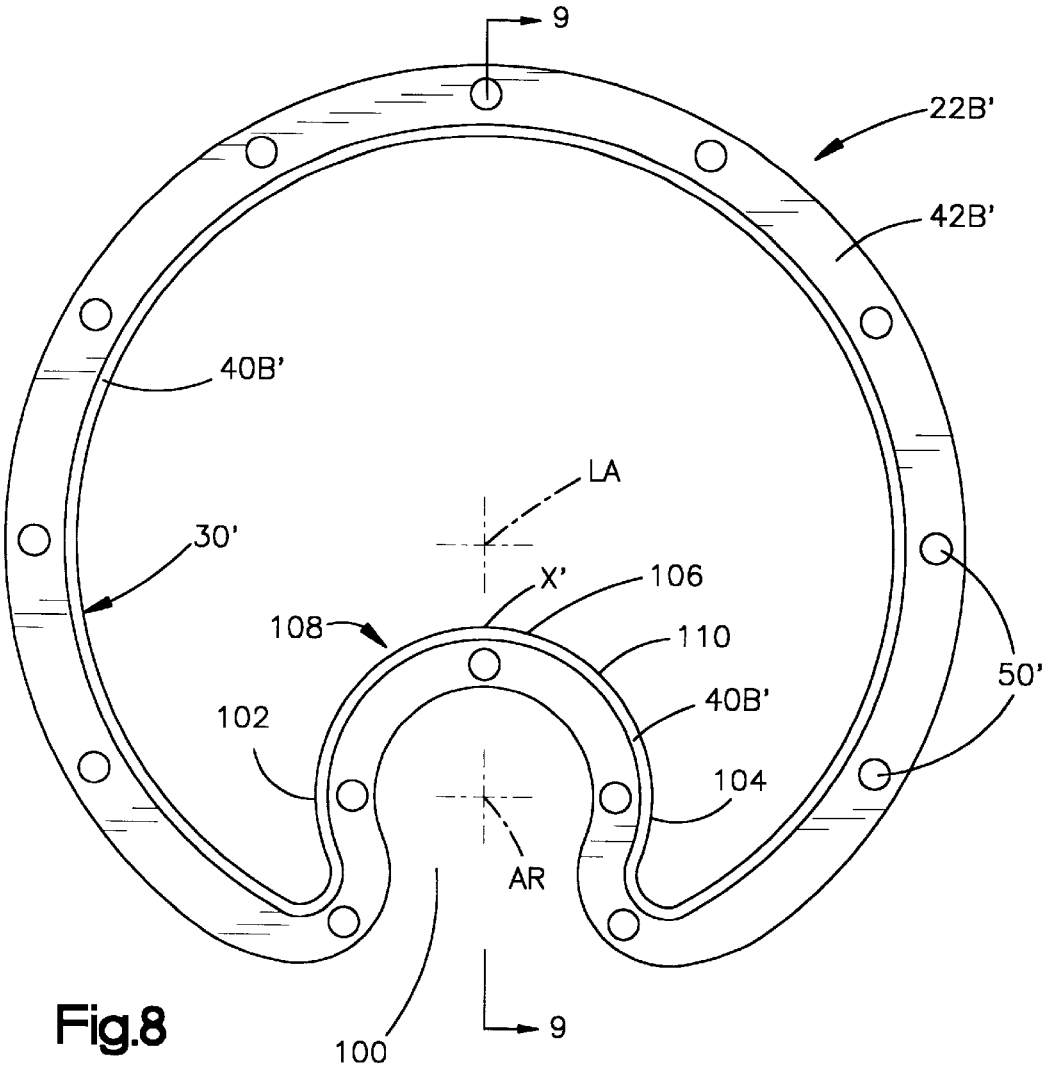
FIG. 8 is a sectional view similar to that of FIG. 4 but showing the cross section of a waveguide constructed in accordance with one embodiment of the present invention.

The present invention is directed toward minimizing or eliminating the gaps 60 and 62. This is accomplished by constructing a ridge which is defined by a trough which extends inwardly and is defined by a pair of circumferentially spaced wall portions which are joined by a connecting wall portion. This structure has a peripheral mounting flange that follows the perimeter of the waveguide, as is shown in FIG. 8 as well as in the double ridge version of FIG. 10. These are described below.

Figure 9:
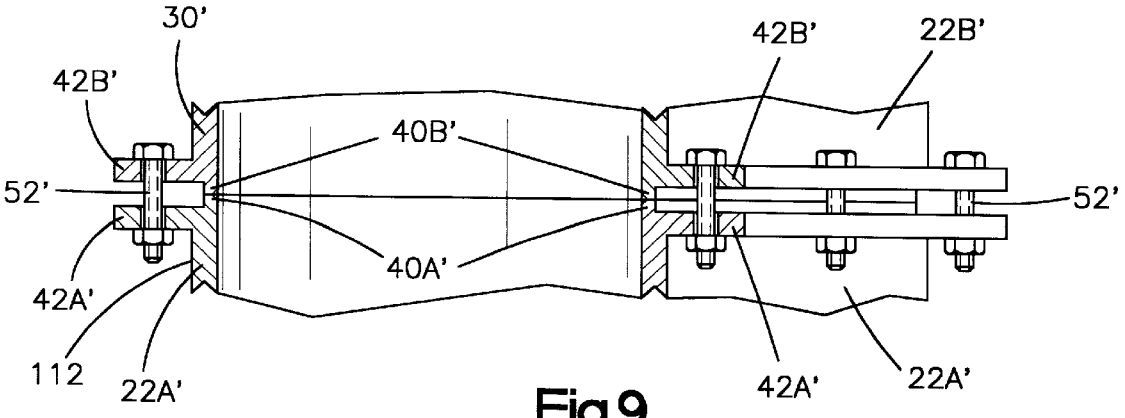
FIG. 9 is a sectional view taken generally along line 9—9 of FIG. 8 and showing two vertically oriented waveguide sections constructed in accordance with the present invention and which have their mounting flanges interconnected with fastening means.

In accordance with one embodiment of the present invention the cross section of each vertical waveguide section takes the form of waveguide section 22B' shown in FIG. 8 along with abutting vertical waveguide section 22A' shown in FIG. 9. To facilitate an understanding of this invention the description that follows with reference to the embodiment of FIGS. 8 and 9 employs character references similar to that used in describing the waveguide of FIGS. 2 and 4. The waveguide section 22B' in FIG. 8 takes the form of an elongated longitudinally extending tubular member having a substantially circular shaped wall 30' which, in cross section, as shown in FIG. 8, substantially coaxially surrounds a longitudinal axis LA. The wall 30' has a longitudinally extending trough portion 100 which extends somewhat radially inward toward the longitudinal axis LA. This trough portion 100 is defined by a pair of circumferentially spaced wall portions 102 and 104 which extend inwardly and are joined together by a connecting wall portion 106. The wall portions 102, 104 and 106 together define a ridge 108 having an inner surface 110 on the interior side of wall 30' and an outer surface 112 (see FIG. 9) on the exterior side of the wall. These surfaces are somewhat circular in cross section having an axis of rotation AR located within the trough 100, as shown in FIG. 8. Each waveguide section has opposing ends and each end has a longitudinally extending peripheral lip ,such as lip 40B' (see FIGS. 8 and 9), extending downwardly from the lower end of section 22B' (see FIG. 9) or the lip 40A' extending upwardly from waveguide section 22A'. The peripheral lip is an extension of the interior side of wall 30' and extends throughout the periphery including the ridge 108. The lip 40A' or 40B' is of a thickness on the order of ½ that of wall 30 in each section 22A' and 22B', as best seen in FIG. 9. The wall 30' may typically have a thickness on the order of ⅛" whereas the lip may have a thickness on the order of 1/16".

The abutting ends of sections 22A' and 22B' are provided with annular mounting flanges 42A' (see FIG. 9) (see FIGS. 8, 9) and 42B' each having an annular array of bolt holes 50' (see FIG. 8). These holes 50' in the flanges 42A' and 42B' are such that when the flanges are in a facing relationship the various holes 50' are registry and the troughs 100 of the two sections are in registry whereby the nut and bolt assemblies 52' (see FIG. 9) may extend through bolt holes 50' to fasten the flanges together. It is to be noted, as best shown in FIG. 9, that the mounting flanges are spaced away from the longitudinal ends of lips 40A' and 40B'.

As is seen in FIG. 8 there are at least three bolt holes located in the mounting flanges within trough 100. Specifically, there is a bolt hole for use with a nut and bolt assembly at the inner most section of ridge 108, with the inner most region being noted by the character X' (this corresponds with the ridge surface area X in FIG. 4). With this construction, the mounting flanges are secured to each other throughout the entire periphery of the structure including the ridge within the trough 100. This structure maintains a secure attachment of the matching ridges during operation when area X' is hot and when the power is lowered or shut off and the area cools down. As a result, the air gaps 60 and 62 in FIGS. 5 and 6 of the prior art are eliminated.

Figure 10:
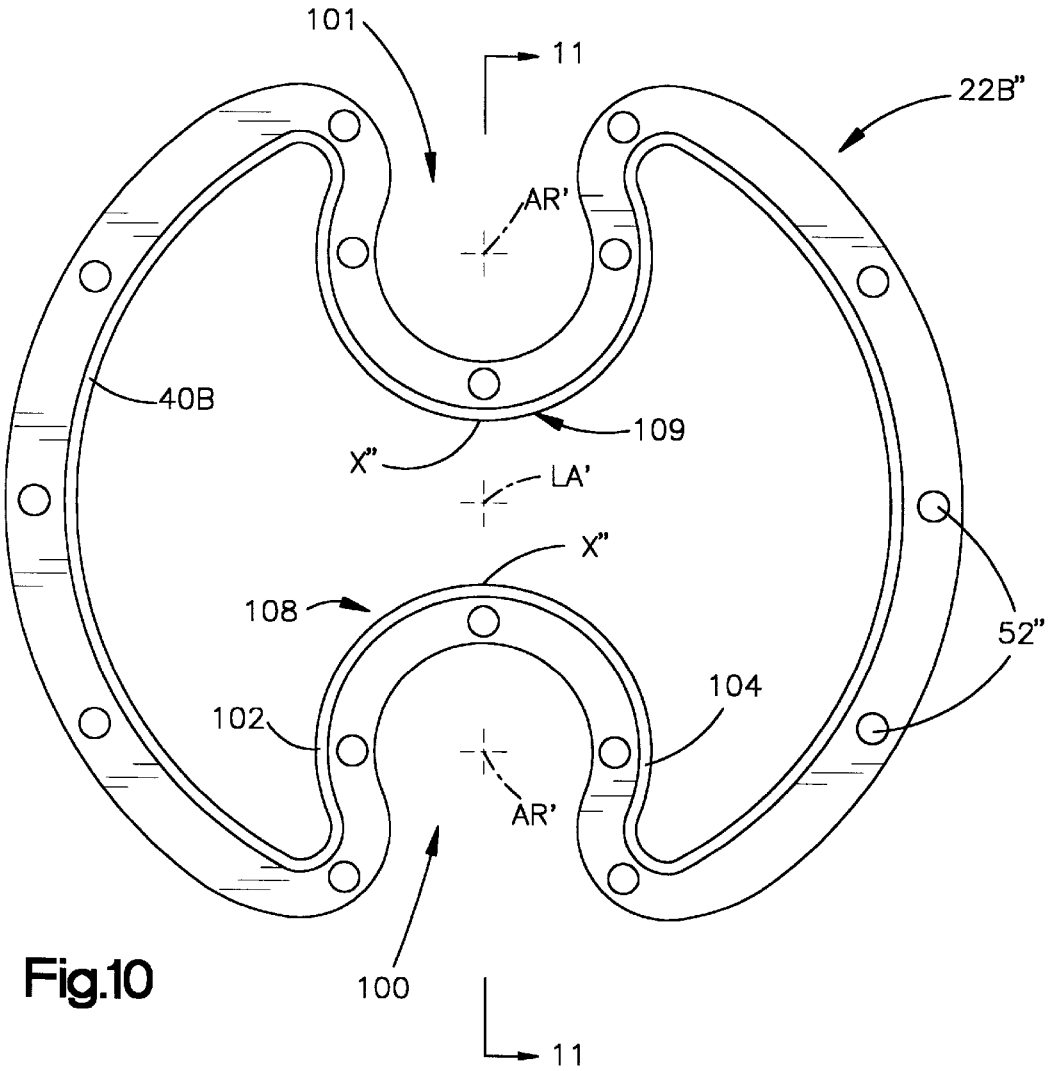
FIG. 10 is a sectional view showing the cross section of a second embodiment of the invention herein.
Figure 11:
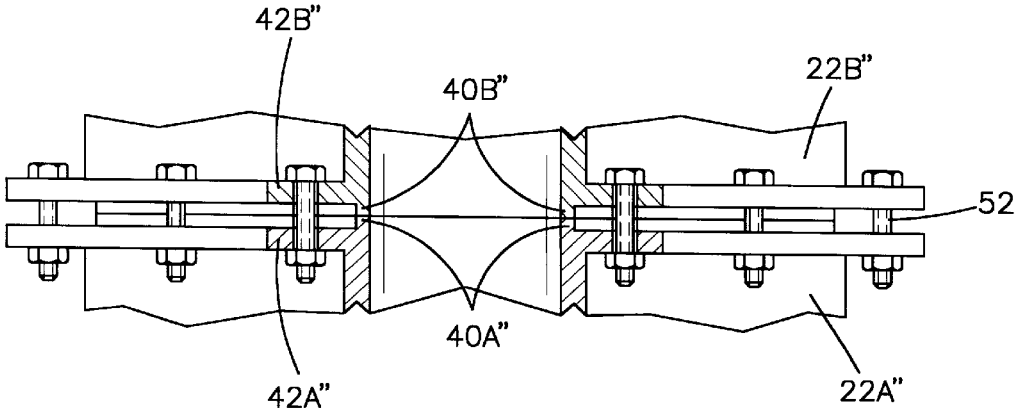
FIG. 11 is a sectional view taken generally along line 11—11 looking in the direction of the arrows in FIG. 10 and showing two vertical waveguide sections having their flanges interconnected.

Reference is now made to FIGS. 10 and 11 which represents another embodiment of the invention similar to that as shown in FIGS. 8 and 9. The embodiment in FIGS. 8 and 9 may be referred to as a single ridge embodiment whereas that as shown in FIGS. 10 and 11 is a double ridge embodiment. Consequently, like components are identified with similar character references. Only the differences over FIGS. 8 and 9 are described below. In this embodiment, a second ridge 109 conforming to that of ridge 108 in FIG. 10 is provided by a second trough 101.

Figure 12:
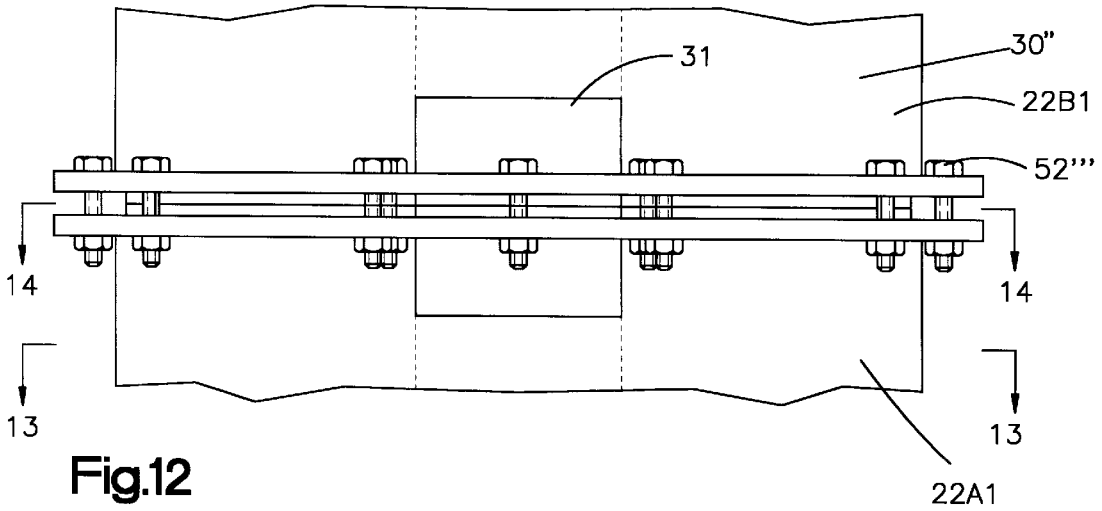
FIG. 12 is an elevational view of another embodiment of the invention.
Figure 13:
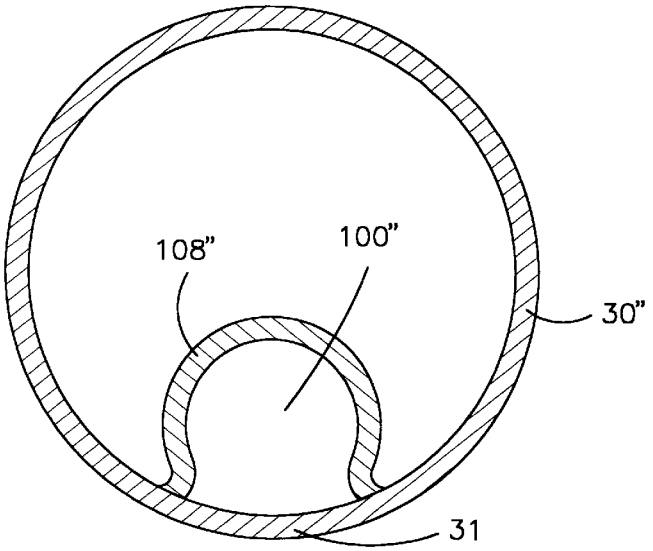
FIG. 13 is a sectional view taken generally along line 13—13 in FIG. 12 looking in the direction of the arrows.
Figure 14:
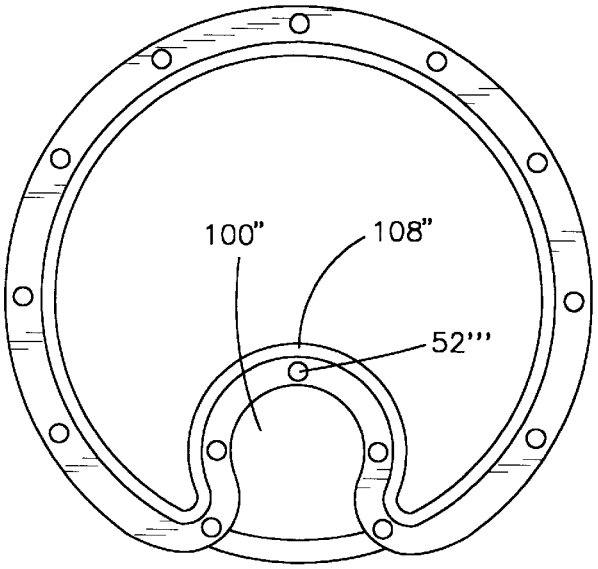
FIG. 14 is a sectional view taken along line 14—14 in FIG. 12 looking in the direction of the arrows.

Reference is now made to FIGS. 12 through 14 which illustrates another embodiment of the invention. This embodiment is similar to that shown in FIGS. 8 and 9 and accordingly similar character references will be employed for similar components. In this embodiment, the wall 30" (see FIGS. 12, 13) is completely cylindrical about the longitudinal axis and has a ridge 108" (see FIG. 12) located within the interior of the waveguide. This ridge may be semi-circular in cross section and welded to the interior of wall 30". This construction being completely cylindrical presents less wind load than that of the embodiments in FIGS. 8–11 since the trough 100" of FIG. 13 is not exposed to the outside air but is covered by a portion 31 of the wall 30". By cutting away a window in wall portion 31 (see FIG. 13) at the abutting ends of two vertical waveguide sections 22A1 and 22B1 (see FIG. 12) access to the trough 100" is provided, as is seen in FIG. 14, so that an operator may have access to the nut and bolt assemblies 52'" (see FIGS. 12 and 14) (for securing abutting sections together). This window in wall portion 31 provides the operator with sufficient access to fasten or unfasten the nut and bolt assemblies.

Figure 15:
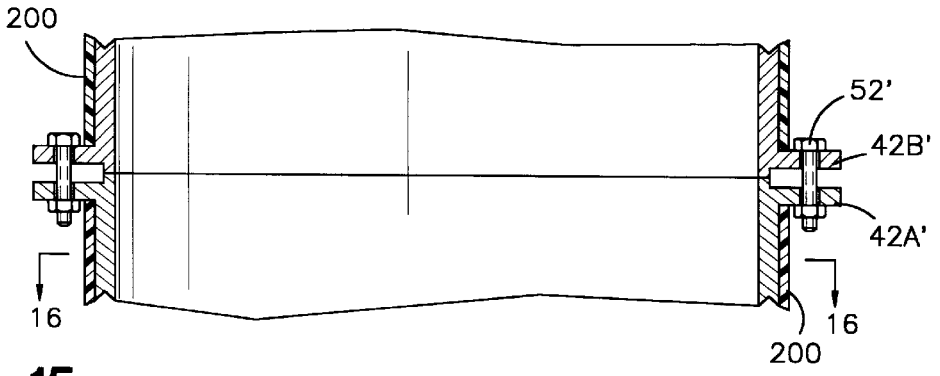
FIG. 15 is an elevational sectional view of another embodiment of the invention wherein each vertical waveguide section has a cylindrical metal or non-metallic tube coaxially surrounding the waveguide except for a section adjacent abutting ends of the waveguide sections.
Figure 16:
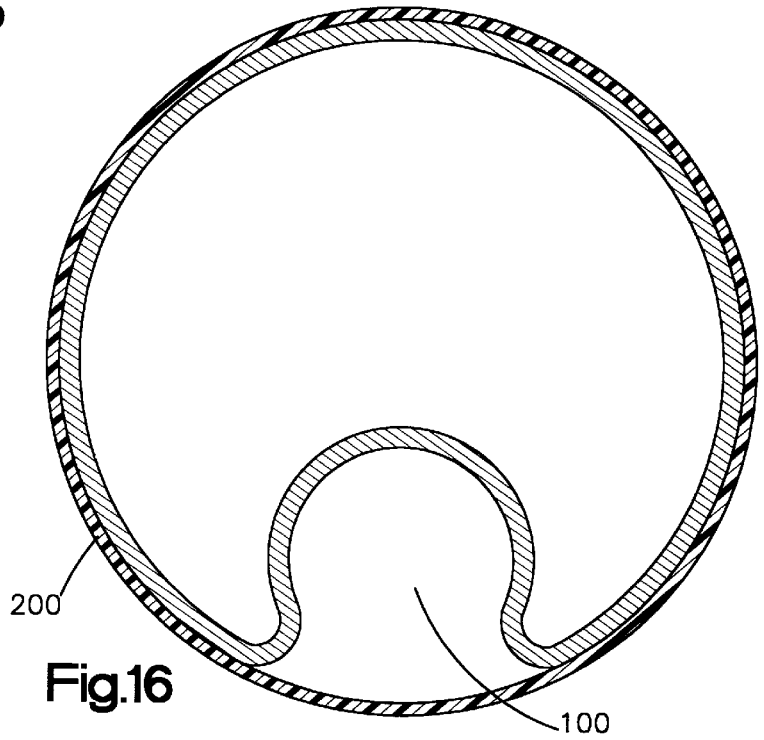
FIG. 16 is a view taken generally along line 16—16 looking in the direction of the arrows in FIG. 15.

Reference is now made to FIGS. 15 and 16 which illustrate a still further embodiment of the present invention. This embodiment is similar to that of the embodiment of FIGS. 8 and 9 and consequently similar components are described with use of similar reference characters. In this embodiment each vertical section is surrounded with a sleeve 200 or the like for essentially all of the length of the section except for an area near the abutting ends of the waveguide sections so as to permit access to the nut and bolt assemblies 52' (see FIG. 15). Otherwise these sections are covered by the sleeve 200 which may be made of suitable material, such as metallic or non-metallic material. As illustrated in FIG. 16 this sleeve covers the area defined by trough 100 and hence provides a structure having less wind load than that of the structure shown in FIGS. 8 and 9.

Figure 17:
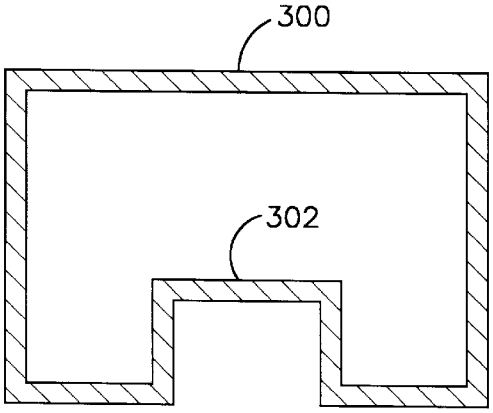
FIG. 17 is a cross sectional view of a single ridge rectangular waveguide suitable for use herein; and, FIG. 18 is a cross sectional view of a double ridge waveguide suitable for use in the invention herein.

As described above, the horizontal waveguide portions 20 and 24 may take the form of rectangular waveguide portions. FIG. 17 illustrates a single ridge rectangular waveguide 300 which may be constructed of aluminum and which has a single ridge 302 formed therein with this ridge extending for the longitudinal length of the waveguide portion. This construction may be employed for the horizontal waveguide portions 20 and 24 with the ridges 302 being properly aligned with ridge 108 (of FIG. 8) so that they together form a continuous interconnecting ridge throughout the length of the waveguide system.

Figure 18:
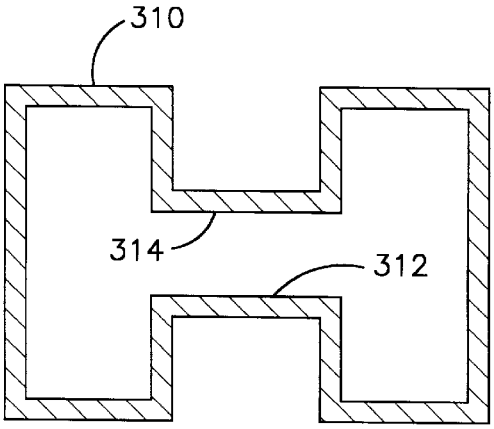

In a similar manner, if a double ridge circular waveguide, such as that shown in FIG. 10, is employed for the vertical waveguide portion 22 then the horizontal rectangular waveguides 20 and 24 may take the form as illustrated in FIG. 18. In this embodiment, the rectangular waveguide 310 has a pair of opposing rectangular ridges 312 and 314 formed therein.

The construction of waveguide sections such as that shown in FIGS. 8 and 9 may, for example, have an interior diameter (including the mounting flange) on the order of 10 inches and an exterior diameter on the order of 11.75 inches. Consequently, the width of the mounting flange is on the order of 0.88 inches. The ridge 108 extends into the interior of the waveguide a distance on the order of 4 inches. Each vertical section will have a length on the order of 10 to 30 feet. The cut off frequency for this waveguide system will be on the order of 425 MHz and the waveguide is operable throughout the entire UHF frequency band (i.e., from 470 MHz to 806 MHz).

From the above description of the invention, those skilled in the art will perceive improvements, changes and modifications in the invention. Such improvements, changes and modifications within the skill of the art are intended to be covered by the appended claims.

Having described the invention, we claim:

1. A waveguide system comprising:

a plurality of waveguide sections each taking the form of an elongated longitudinally extending tubular member having a substantially circular shaped wall in cross section which substantially coaxially surrounds a longitudinal axis, said wall having a longitudinally extending trough portion extending radially inward toward said longitudinal axis, said trough portion defined by a pair of circumferentially spaced wall portions extending inwardly and joined together by a connecting wall portion, said wall portions together defining a ridge having an inner surface on an interior side of said wall and an outer surface on an exterior side of said wall, each said waveguide section having opposing ends with each said end having a longitudinally extending peripheral lip at said ridge, said wall having at each said end an annular mounting flange extending essentially radially outward from the exterior side of said wall, and a plurality of spaced apart fastening means interconnecting the annular mounting flanges of adjoining waveguide sections together in such a manner that at least one of said fastening means is located in said trough portion and is adjacent said connecting wall portion for securely fastening said sections together including the respective ridges defined by said trough portion.

2. A waveguide system as set forth in claim 1 wherein said peripheral lip extends longitudinally along an entire inner periphery of said wall.

3. A waveguide system as set forth in claim 2 wherein said lip is of a thickness less than that of said wall.

4. A waveguide system as set forth in claim 1 wherein said mounting flange is continuous about the outer periphery of said wall and extends radially outward therefrom.

5. A waveguide system as set forth in claim 1 and includes means covering said trough portion for at least a substantial portion of the respective length between opposing ends of each said waveguide section.

6. A waveguide system as set forth in claim 5 wherein said covering means includes a tubular member which extends coaxially about said wall.

7. A waveguide system as set forth in claim 1 including a second said ridge defined by a second said trough portion such that said first and second ridges face each other within said waveguide section.

8. A waveguide system as set forth in claim 7 wherein said lip extends longitudinally along an entire inner periphery of said wall.

9. A waveguide system as set forth in claim 8 wherein said lip is of a thickness less than that of said wall.

10. A waveguide system as set forth in claim 7 wherein said mounting flange is continuous about the outer periphery of said wall and extends radially outward therefrom.

11. An end mounted wave guide section comprising:

a first elongated conductive tubular member having an inner surface and outer surface and having a longitudinal axis extending there through and a second elongated conductive tubular member having an inner surface and an outer surface having a length equal to a length of the first tubular member and a cross section substantially smaller than a cross section of the first tubular member, said second tubular member attached to the inner surface of the first tubular member and having an longitudinal axis extending parallel to the axis of the first tubular member, the arrangement being such that the first and second tubular members define a wave guide section, and mounting means at opposite sides of the wave guide section including external flange members at opposite ends of the wave guide section, each external flange member extending outward from the external surface of the first member over a substantial portion of the outer surface of the first tubular member and adjacent the separate ends of the first tubular member, each external flange member including a plurality of holes provided therein to receive fasteners for fastening to other wave guide sections, internal flange members at opposite ends of the wave guide section, each internal flange member extending outwardly from the outer surface of the second tubular member and adjacent the separate ends of the second tubular member and including a plurality of holes provided therein at locations that are inwardly spaced from the inner surface of said first tubular member to receive said fasteners for fastening to said other wave guide sections.

12. An end mounted wave guide section as defined in claim 11 wherein:

the first tubular member is provided with a slit extending longitudinally along said length thereof and parallel to said longitudinal axis thereof, and the second tubular member is mounted to the inner surface of the first tubular member adjacent to opposite sides of the slit provided in the first tubular member and is also provided with a slit that extends along the length of the slit in the first tubular member.

13. An end mounted wave guide section as defined in claim 11 wherein:

the first and second tubular members are provided formed with a common opening adjacent to each end of the wave guide section at the location at which the second tubular member is attached to the first tubular member.

14. An end mounted wave guide section as defined in claim 11 wherein:

one of the holes provided in the internal flange is located in that portion of the internal surface near the longitudinal axis of the first tubular member.

15. A flange mounting arrangement on opposite ends of wave guide section for coupling to wave guide sections having similar flange mounting arrangements, wherein the wave guide sections include a first elongated tubular member having a longitudinal extending axis there through and a second elongated tubular member having a cross section which is substantially smaller than a cross section of the first tubular member and having a longitudinal axis extended there through, said second tubular member secured to an inner surface of the first tubular member with the axis of the second tubular member substantially parallel to the axis of the first tubular member with ends of the first and second tubular members being in alignment, the flange mounting arrangement comprising:

a first flange portion adjacent each end of the wave guide section extending circumferentially from the first tubular member over a substantial portion of an external surface of the first tubular member having flange surfaces in alignment with the ends of the first tubular member, the first flange portions including a plurality of holes provided therein for receiving mounting bolts, and a second flange portion adjacent each end of the wave guide section extending from the second tubular member over a substantial portion of an outer surface of the second tubular member having flange surfaces in alignment with the ends of the second tubular member, the second flange portions including a plurality of holes provided therein at locations that are inwardly spaced from said inner surface of said first tubular member for receiving said mounting bolts.

16. A flange mounting arrangement as defined in claim 15 wherein:

one of the holes provided in the second flange portion is located adjacent to that portion of the internal surface of the second flange portion near the longitudinal axis of the first tubular member.

17. A method of coupling opposite ends of first and second wave guide sections together, wherein the wave guide sections include a first tubular member having a longitudinal axis there through and a second tubular member having a substantially smaller cross section than the first tubular member having a longitudinal axis there through secured to the inner surface of the first tubular member with its axis generally parallel to the axis of the first tubular member with the ends of the first and second tubular members in alignment, the method of coupling comprising:

providing a first flange portion, having mounting holes formed therein, adjacent each end of the wave guide section extending from the external surface of the first tubular member and having separate flange surfaces in alignment with separate ends of the first tubular member, providing a second flange portion, having mounting holes formed therein, adjacent each end of the wave guide section extending from an outer surface of the second tubular member and having separate flange surfaces in alignment with separate ends of the second tubular member, wherein at least one of the holes of said second flange portion is located inwardly of the inner surface of first tubular member and near the axis of the first tubular member, and securing respective ones of the first and second flange portions of one second wave guide section to corresponding first and second flange portions of another wave guide section by said bolts extending through the first and second flanges of the one second and another wave guide section.

* * * * *